US005524303A

United States Patent [19]

Palmer, Jr. et al.

[11] Patent Number: 5,524,303

[45] Date of Patent: Jun. 11, 1996

[54] PERSON LIFTER/ROTATOR

[76] Inventors: John M. Palmer, Jr., P.O. Box 115, Lutz, Fla. 33549; John M. Palmer, III, P.O. Box 823291, Dallas, Tex. 75382

[21] Appl. No.: 424,554

[22] Filed: Apr. 17, 1995

Related U.S. Application Data

[63] Continuation of Ser. No. 105,348, Aug. 10, 1993, abandoned.

[51] Int. Cl.[6] ..... A61G 7/10

[52] U.S. Cl. ..... 5/81.1 RP; 5/662; 5/507.1

[58] Field of Search ..... 5/81.1, 83.1, 86.1, 5/89.1, 507.1, 602

[56] References Cited

U.S. PATENT DOCUMENTS

| | | | |
|---|---|---|---|
| 2,747,652 | 5/1956 | Marsh | 5/81.1 X |
| 2,757,388 | 8/1956 | Chisholm | 5/507.1 |
| 2,914,110 | 11/1959 | Schulte | 5/81.1 X |
| 2,963,713 | 12/1960 | Forrest | 5/507.1 |
| 3,137,869 | 6/1964 | Johnson | 5/86.1 |
| 3,374,493 | 3/1968 | Herrera | 5/86.1 |
| 3,397,883 | 8/1968 | Kiehn | 5/86.1 X |
| 3,911,509 | 10/1975 | Fleckenstein | 5/507.1 |
| 3,940,808 | 3/1976 | Petrini . | |
| 4,279,043 | 7/1981 | Saunders | 5/81.1 |
| 4,569,094 | 2/1986 | Hart et al. . | |
| 4,571,757 | 2/1986 | Samuelsson . | |
| 4,680,819 | 7/1987 | James . | |
| 4,703,523 | 11/1987 | James . | |
| 4,829,612 | 5/1989 | Adams | 5/81.1 |
| 4,918,771 | 4/1990 | James . | |
| 4,948,156 | 8/1990 | Fortner | 5/81.1 X |
| 4,999,862 | 3/1991 | Hefty . | |
| 5,054,137 | 10/1991 | Christensen | 5/81.1 |
| 5,058,221 | 10/1991 | Abraham | 5/81.1 |
| 5,096,008 | 5/1992 | Mankowski . | |
| 5,384,922 | 1/1995 | Jobe | 5/81.1 |

*Primary Examiner*—Michael F. Trettel

[57] ABSTRACT

The lifter/rotator device of the present invention is useful in assisting a user to raise from a sitting position to a standing position, rotating to a different direction, and resitting on another device or piece of furniture. Embodiment (16) shows base (40B) incorporated in a wheelchair (100). Vertical support column (60B) is mounted off center on a powered rotatable standing platform (50B). Parallel linkage lifting arms (94) and (94') connect pivot assembly (69) on top of support column (60B) to body rest (92). By activating the controls on hand grip and controls (98) a user is lifted upward and forward, rotated to another direction, and lowered on another device. Platform (91) is for a legless user not needing the more elaborate support provided by body rest (92). Storage tank (110) supplies compressed air for driving the various functions.

26 Claims, 5 Drawing Sheets

PERSON LIFTER/ROTATOR

RELATED U.S. APPLICATION DATA

This is a continuation of patent application Ser. No. 08/105,348 filed on Aug. 10, 1993 now abandoned.

BACKGROUND-FIELD OF INVENTION

This invention relates to equipment used in homes, nursing homes, retirement homes, hospitals, and other private and public places for moving elderly and disabled persons on and off beds, wheelchairs, furniture, and other devices. The device of this invention is specifically designed for assisting a person to rise from a sitting position to a generally standing position, rotating him or her to a different direction, and resitting on a different device or piece of furniture. It can be operated by the user without assistance from a caregiver in many cases.

BACKGROUND-DESCRIPTION OF PRIOR ART

Many borderline ambulant disabled persons are generally able to care for themselves. However, transferring from one device to another often becomes the function that makes them dependent on a caregiver. Presently the lift and tilt chair is useful in helping a person assume a standing position, but it is only useful in its stationary location and it lacks the capability of rotating its user. Wheelchairs incorporating features of the lift chair such as those shown in Fortner, U.S. Pat. No. 4,948,156 and Mankowski, U.S. Pat. No. 5,096,008 allow the user the privilege of standing wherever the wheelchair can travel. Unfortunately, they do not assist the user in turning around and sitting on another device.

James, U.S. Pat. No. 4,918,771 and 4,703,523 shows transfer devices that must be operated by a caregiver. Petrini's device, U.S. Pat. No. 3,940,808 also requires a caregiver for its operation.

Hefty, in U.S. Pat. No. 4,999,862 and Hart et al., U.S. Pat. No. 4,569,094 show devices that are too high and bulky to be practical in most environments.

OBJECTS AND ADVANTAGES

Accordingly, objects and advantages of the present invention are:

(a) to provide a device to assist a person in standing from a sitting position, rotating to a different direction, and then resitting;

(b) to provide a device that can be operated by the user in many cases;

(c) to provide a device that can be furnished as either a stationary model or a mobile model;

(d) to provide in a mobile model a device that is low enough to traverse under a dining table or office desk;

(e) to provide a device that can be electric, hydraulic, or pneumatically powered;

(f) to provide a device that can be attached to or incorporated into the fabrication of a wheelchair, lawn mower, tractor, or other traveling machine or device;

(g) to provide a device that is light in weight;

Further objects and advantages are to provide a device that can be economically manufactured and distributed. Still further objects and advantages will become apparent from a consideration of the ensuing description and drawings.

DRAWING FIGURES

In the drawings, closely related figures have the same number but different alphabetic suffixes.

REFERENCE NUMERALS IN DRAWINGS

1–10 Figs.
11–18 embodiments
20 bed
30–32 wheelchair and user
40–49 base
50–56 rotating standing platform
60–69 vertical support column
70–78 body engaging parts
80–89 pulling system
90–99 parallel linkage lifting arm system
100–104 device attached to a wheelchair
110 compressed air supply tank

DESCRIPTION OF THE PREFERRED EMBODIMENTS

Figure 1:
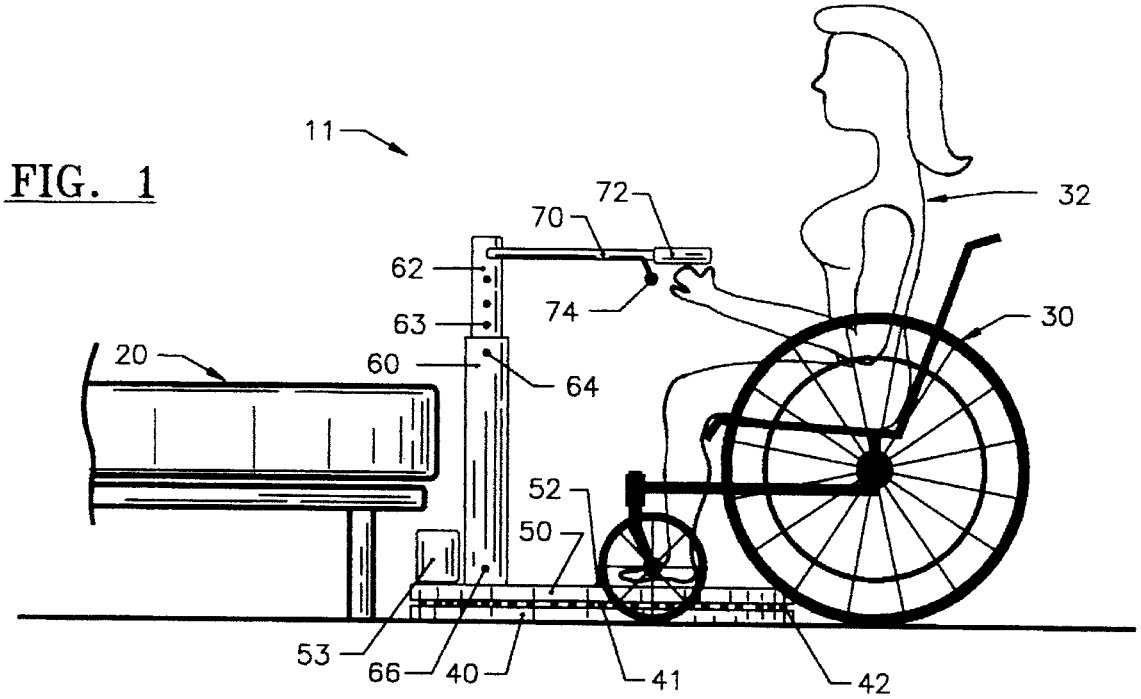
FIG. 1 is an elevation view of a stationary Person Lifter/Rotator positioned for a user sitting in a wheelchair to grip the handles of this invention.
Figure 2:
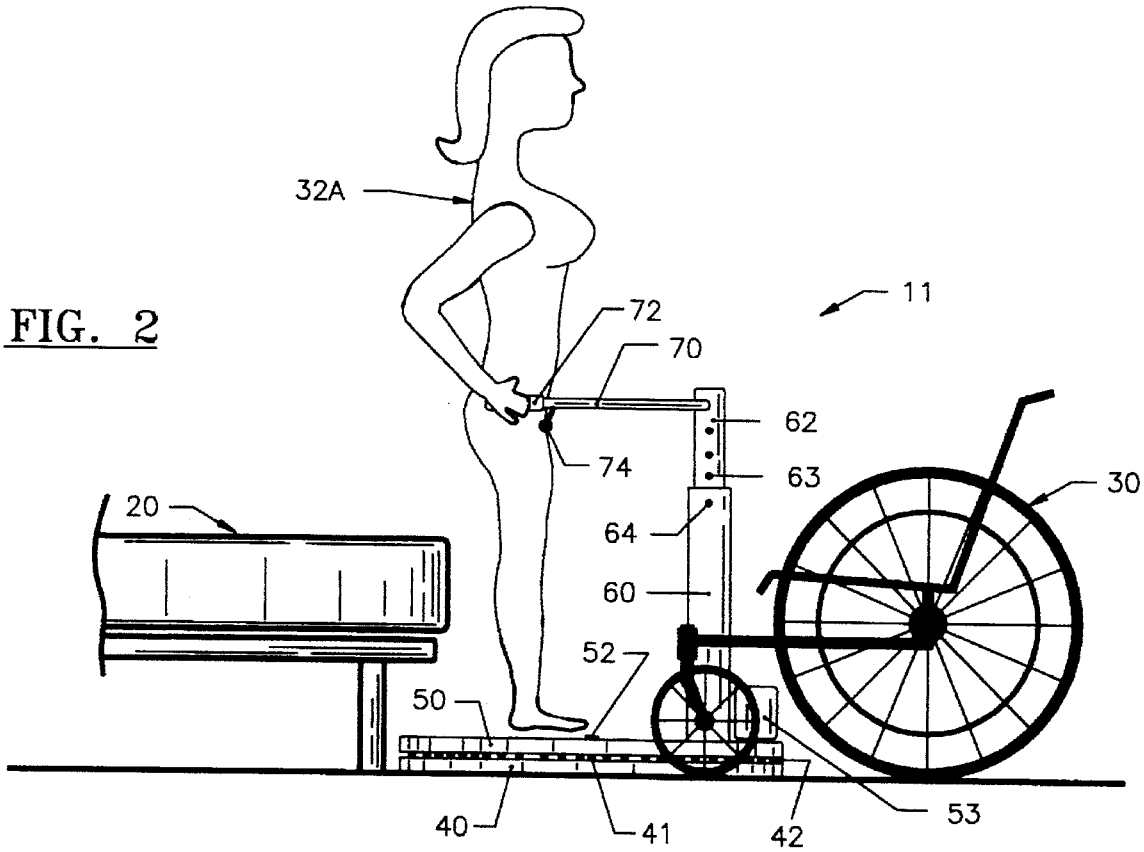
FIG. 2 is an elevation view similar to that of FIG. 1 showing the person standing on the standing platform of the device and rotated 180 degrees.

A preferred embodiment 11 of the present invention is illustrated in its most basic configuration in FIG. 1 and FIG. 2. Base 40 which is placed on the floor must be stable enough to prevent overturning while a user is preforming the standing process. For a permanent installation it can be rigidly affixed to the floor. Powered rotating standing platform 50 rotates about vertical axle 41 and on bearings 42 of base 40. Retainer 52 holds together base 40 and standing platform 50. Vertical support column 60 is fixed to standing platform 50, however, it may be mounted off center thereby providing a user more unobstructed standing room and it may be detachable for ease of transporting if desired by withdrawing connector 66. The height of the vertical support column may be adjustable by placing inner support column part 62 inside vertical support column 60 and holding it in position by inserting retainer 64 through a desired hole 63 in inner support column 62. Handle bar 70 with hand grips 72 attaches to inner support column 62. Electric, pneumatic, or hydraulic control switch 74 actuates drive motor/brake 80 which power rotates standing platform 50.

During use a wheelchair 30 user 32 will place his or her feet on the powered rotating standing platform 50 and will pull up to a standing position 32A. Standing user 32A or a caregiver (not shown) activates switch 74 so that the device (except for base parts 40) rotates to a new direction. Bed 20 represents the device user 32A is now positioned to sit on.

Figure 3:
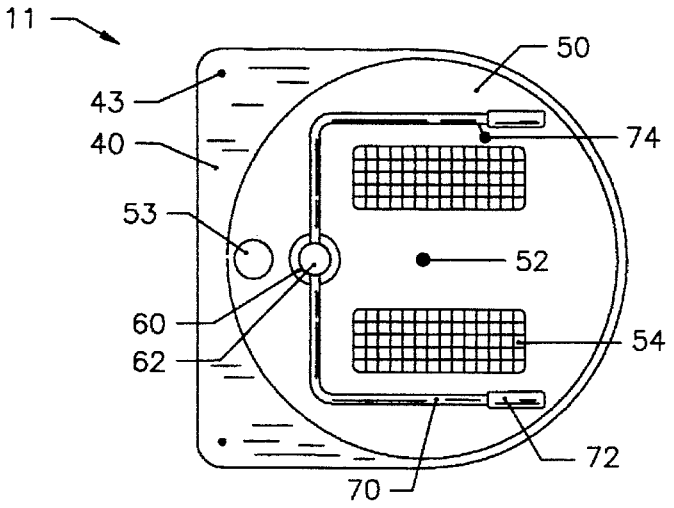
FIG. 3 is a plan view of the device of FIG. 1.

FIG. 3 shows parts previously described plus holes 43 in base 40 for securing the device to a firm surface. Anti-skid surface 54 is useful in preventing a user's feet from slipping during the transfer process.

Figure 4:
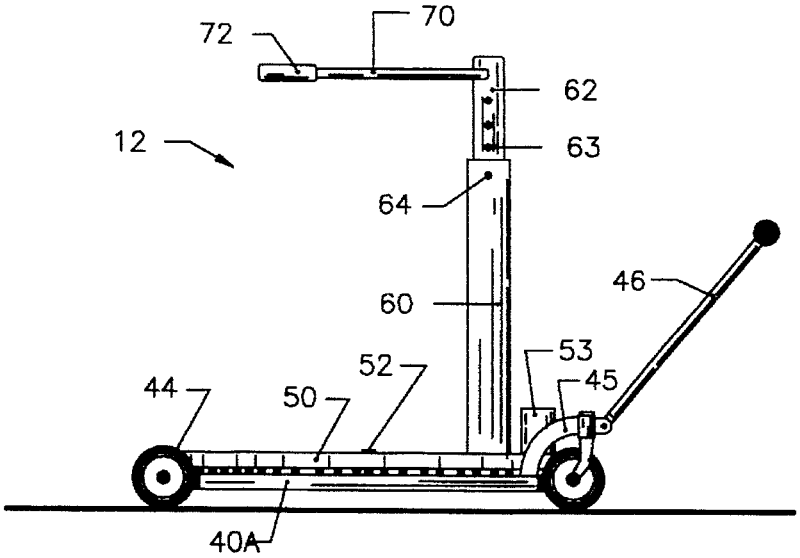
FIG. 4 is an elevation view of a Person Lifter/Rotator having wheels for mobility and a handle for pulling.
Figure 5:
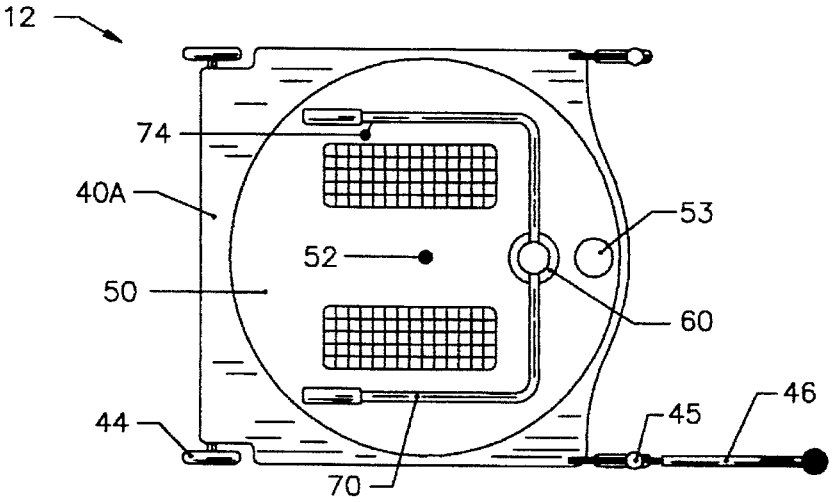
FIG. 5 is a plan view of the device of FIG. 4.

FIG. 4 and FIG. 5 show embodiment 12 with base 40A mounted on wheels 44 which may be powered. For transporting a heavy person it may be desirable to provide powered drive wheels 44 which would be battery powered. Caster assembly 45 and offset tow handle 46 allow for easy moving of the device to different locations.

Figure 6:
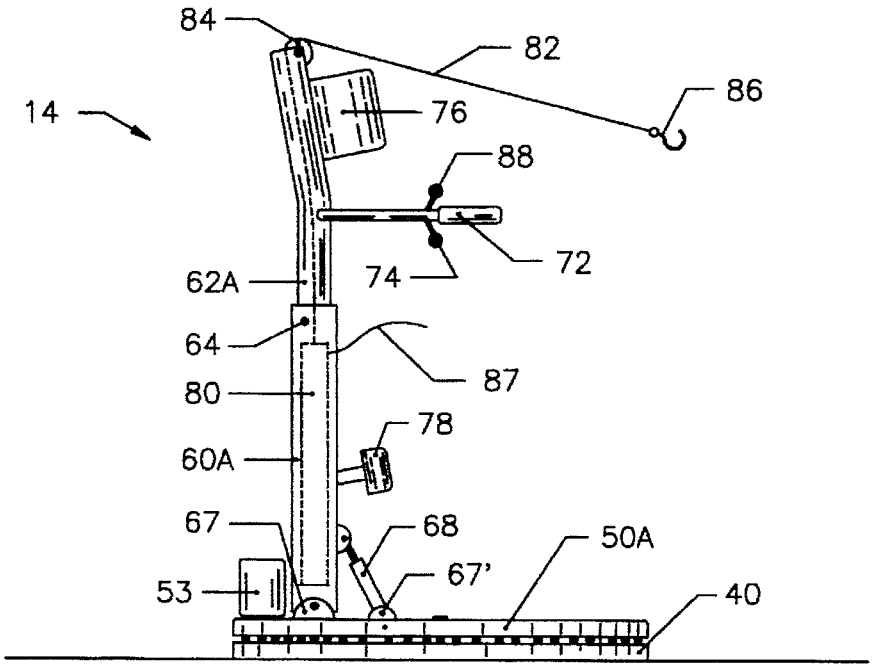
FIG. 6 is a side elevation view of a Person Lifter/Rotator having a pulling device within the vertical support column.
Figure 7:
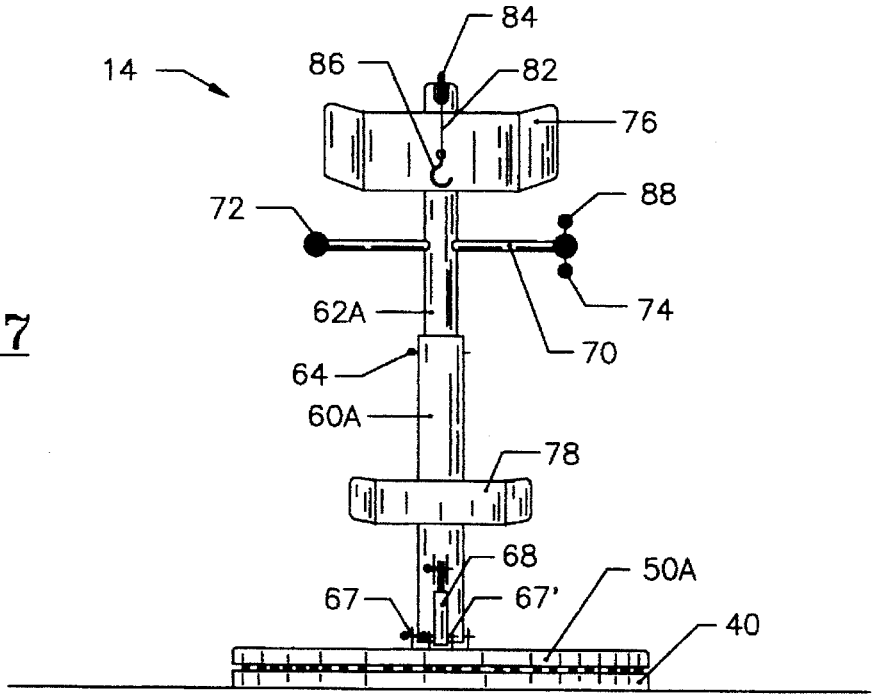
FIG. 7 is a front elevation view of the device of FIG. 6.

FIG. 6 and FIG. 7 show embodiment 14 having powered features for assisting a user in standing. Powered rotating standing platform 50A has fittings 67 and 67' to pivotally connect vertical support column 60A and tilt drive 68. In some cases it will be advantageous to tilt vertical support column 60A toward the user before lifting and rotating. Chest support 76 is attached to column part 66 and knee support 78 has been added to vertical support column 60A. Rodless pneumatic or hydraulic cylinder 80 is mounted within vertical support column 60A. Pulling cable 82 connects to a piston in rodless cylinder 80, travels over sheave 84, and connects to hook 86. Hook 86 attaches to a belt or sling that will be fitted around the waist or chest of the user. Upon activation of switch 88 compressed gas or a liquid from hose 87 supplies the force to move rodless cylinder 80 causing the user to be pulled forward and upward. The chest support 76 and knee support 78 steady the user during the standing and rotating process.

Figure 8:
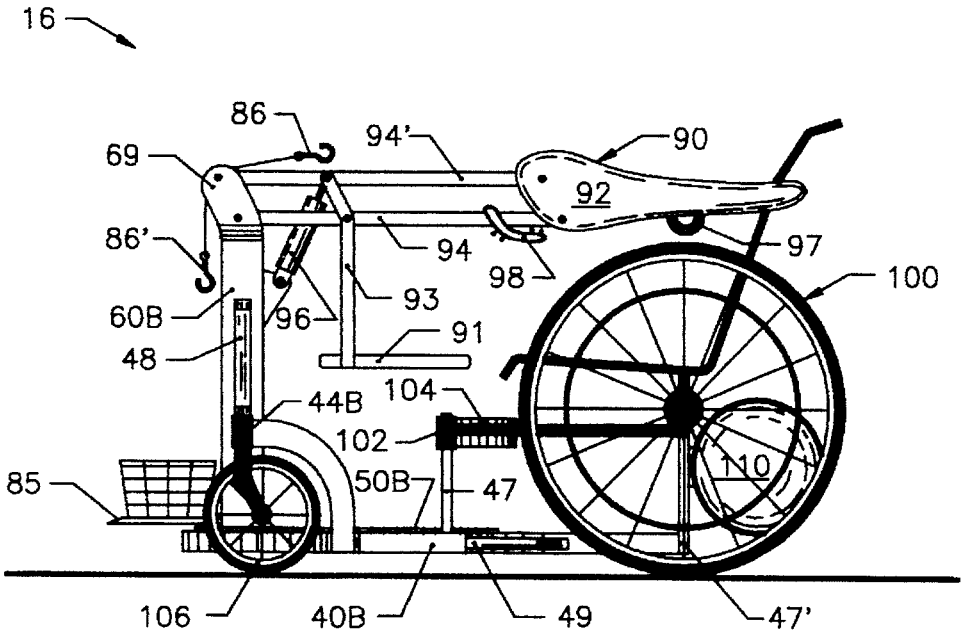
FIG. 8 is a side elevation view of a Person Lifter/Rotator attached to or incorporated into the fabrication of a wheelchair.
Figure 9:
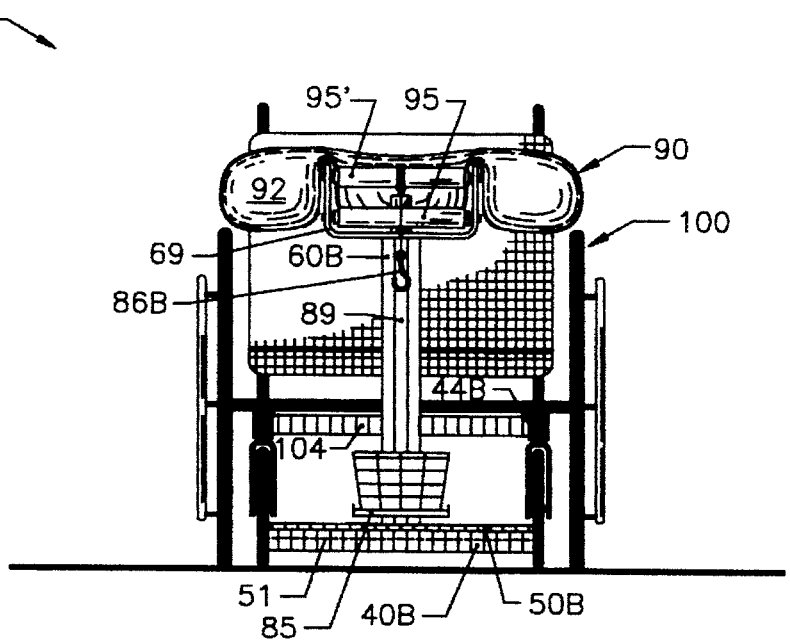
FIG. 9 is a front elevation view of the device of FIG. 8.

FIG. 8 and FIG. 9 show in embodiment 16 that the lifter/rotator of the present invention can be incorporated in the original construction of a wheelchair (not specifically shown) or can be attached to an existing wheelchair 100. Base 40B attaches to wheelchair 100 with stud 47 inserted in hub 102 (the hub in which the original front wheel casters resided) and fitting 48 to an aft point on the frame. New caster hub assembly 44B receives wheelchair 100 original wheel and caster assembly 106. Vertical actuator 47 raises and lowers wheel and castor assembly 106 for leveling the device, on unlevel surfaces, for a safer lifting and rotating process. Horizontal slide 49 traveling in base 40B is connected to caster hub assembly 44B providing for forward and aft movement of wheel and caster assembly 106. This will, for instance, allow one front wheel of the wheelchair to be over a curb and on the roadway while the other wheel remains on the sidewalk. Part 104 may be added as a kick plate. Vertical support column 60B mounted off-center on powered rotating standing platform 50B is capped with a parallel linkage lifting arm system 90 pivot assembly 69. Within vertical support column 60B is an optional vertical slide lift system which raises and lowers utility platform 85. A slot in one side of vertical support column 60B allows connecting the utility platform 85 to vertical slide 89. Additional lift and pull hooks 86 and 86' are provided. One end of near side parallel linkage lifting arms 94 and 94' (identical far side arms are not shown) connect to pivoting axles 95 and 95' and the other end connects to similar axles in the padded body rest 92. The padded body rest 92 illustrated wraps around a user's chest and under his or her arms so as to distribute the lifting forces over a user's torso and limbs as much as possible. Other body engaging configurations such as a slide platform 91 suspended 93 from a shortened parallel linkage lifting arm system 94 and 94' for a legless person could be used as well. The user would slide from the device he or she is presently sitting onto the platform 91, rotate to the new direction desired, raise or lower the platform 91 colevel with the device to be seated on and sliding onto the new device for an easy transfer. Hook 97 can be used to attach a sling if desired. Handle and control console 98 provides a gripping surface and control functions for both powered rotating and lifting. Actuator 96 pivots arms 94 and 94' between a horizontal and a vertical position thereby lifting a user forward and upward. Storage tank 110 supplies compressed gas to the various rotating and lifting systems. The actuators could be electrically driven if desired, and storage tank 110 would be replaced with a battery.

Figure 10:
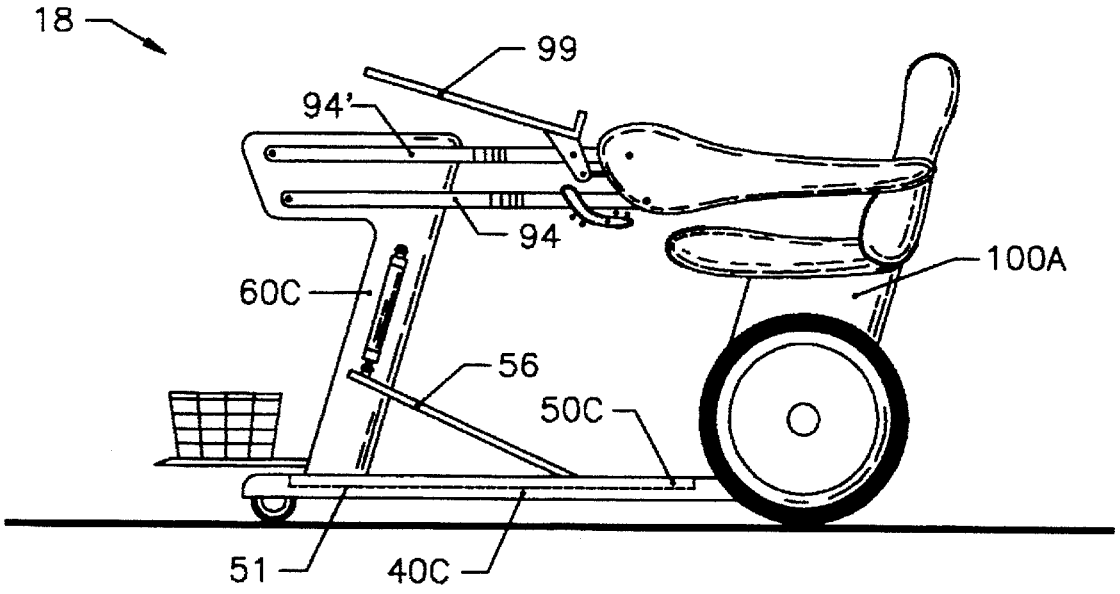
FIG. 10 is a side elevation view of a Person Lifter/Rotator incorporated in the fabrication of a three or four wheel mobility device.

FIG. 10 illustrates in embodiment 18 the device incorporated in a mobility vehicle 100A similar to those used by the elderly for making short trips around their neighborhood. 51 represents the bearing plane on which standing platform 50C rotates. Foot rest 56 is adjustably inclined with actuator 60C. 99 represents an adjustable work surface that will maintain its preset incline regardless of the position of lifting arms 94 and 94'. It would be simple to install the device in many types of equipment, for instance tractors, lawn mowers, boats, lift trucks, etc.

SUMMARY OF THE INVENTION

Accordingly, the reader will see that the present invention describes a system for assisting a disabled person in standing, turning to a different direction, and sitting on another device or piece of furniture. Furthermore, the device has additional advantages in that it can be furnished as either a stationary or mobile unit;

it provides for a selection of lifting configurations, from simple gripping handles to elaborate body engaging rests and slings. A user could start with a simple system and as his or her condition deteriorates upgrade to another system by just changing the lifting assembly. The base and rotating part of the device would not require changing;

in a pneumatic configuration it allows a user to "bounce up" as he or she did before becoming completely unable to stand. By adjusting the air pressure just enough to complete the standing process the user is still able to use his or her muscles;

it provides for a variety of controls, such as finger, toe, voice, sip and puff, etc. This feature enables many users to make a transfer unassisted by a caregiver.

Preferred embodiments and variants have been suggested for this invention. Other modifications may be made, as by adding, combining, deleting, or subdividing components, parts, or steps, while retaining advantages and benefits of the present invention—which is defined in the following claims.

Thus the scope of the invention should be determined by the appended claims and their legal equivalents, rather than by the examples given.

We claim:

1. A device for assisting a person to rise from a reclining or sitting position to a standing position, rotating to a new direction, and reclining or sitting on another device or walking from said device comprising:

a base, said base configured for placing on a floor;

a standing platform rotationally mounted on said base, said standing platform sufficient in size for a person to stand on;

a vertical support column mounted on said standing platform;

powered drive means for rotating and braking said standing platform relative to said base;

control means for actuating said powered drive means; and gripping means attached to said vertical support column.

2. A device as defined in claim 1, wherein said vertical support column is mounted off center near the peripheral edge on the top surface of said standing platform providing more unobstructed area for said person to stand.

3. A device as defined in claim 1, wherein said standing platform is cylindrical in shape, the peripheral edge of said standing platform being a surface for receiving a driving means.

4. A device as defined in claim 1, wherein said driving means includes a pneumatic motor or cylinder driven by compressed gas from a compressed gas supply means.

5. A device as defined in claim 4, wherein said compressed gas supply means is a scuba tank.

6. A device for assisting a person to rise from a reclining or sitting position to a standing position, rotating to a new direction, and reclining or sitting on another device or walking from said device comprising:

a base, said base configured for placing on a floor;

a standing platform rotationally mounted on said base, said standing platform sufficient in size for a person to stand on;

a vertical support column mounted on said standing platform;

powered drive means for rotating and braking said standing platform relative to said base;

powered lifting means attached to said vertical support column, said lifting means attached to said person by a body engaging means; and control means for actuating said powered drive means and said powered lifting means.

7. A device as defined in claim 6, wherein said vertical support column is mounted off-center, near the peripheral edge and on the top surface of said standing platform providing more unobstructed area for said person to stand.

8. A device as defined in claim 6, wherein said standing platform is cylindrical in shape, the peripheral edge of said standing platform being a surface for receiving a driving means.

9. A device as defined in claim 6, wherein said powered drive means and said powered lifting means includes a pneumatic motor or cylinder driven by compressed gas from a compressed gas supply means.

10. A device as defined in claim 9, wherein said compressed gas supply means is a high pressure storage tank such as a scuba tank.

11. A device as defined in claim 6, wherein said vertical support column contains a pulling means.

12. A device as defined in claim 11, wherein said pulling means comprises a rodless type pneumatic or hydraulic cylinder and a pulling cable.

13. A device as defined in claim 6, further including means attached to said vertical support column for pivoting parallel linkage lifting arms, said parallel linkage lifting arms connecting said pivoting means on said vertical support column to said lifting means, and means for selectively pivoting said parallel linkage lifting arms to one of a plurality of positions.

14. A device as defined in claim 6, wherein said body engaging means comprises an under the arms support which remains horizontal when lifted or lowered and distribute lifting forces over a sizeable area of said person.

15. A device as defined in claim 6, wherein said lifting means comprises a flat platform, similar to a slide board, which remains horizontal when lifted or lowered, on which a legless person may slide on and off to make a transfer.

16. A device for assisting a person to rise from a reclining or sitting position to a standing position, rotating to a new direction, and reclining or sitting on another device or walking from said device comprising:

a base, said base incorporated into the construction of a wheelchair, said base located between the main wheels and the front casters of said wheelchair and a distance above the surface said wheelchair is designed to travel over a standing platform rotationally mounted on said base, said standing platform sufficient in size for a person to stand on;

a vertical support column mounted on said standing platform;

powered drive means for rotating and braking said standing platform relative to said base;

powered lifting means attached to said vertical support column;

body engaging means for attachment of said lifting means to a person; and control means for actuating said powered drive means and said powered lifting means.

17. A device as defined in claim 16, wherein said vertical support column is mounted off-center near the peripheral edge on the top surface of said standing platform providing more unobstructed area for said person to stand.

18. A device as defined in claim 16, wherein said standing platform is cylindrical in shape, the peripheral edge of said standing platform being a surface for receiving a driving means.

19. A device as defined in claim 16, wherein said powered drive means and powered lifting means includes a pneumatic motor or cylinder driven by compressed gas from a compressed gas supply means.

20. A device as defined in claim 19, wherein said compressed gas supply means is a high pressure storage tank such as a scuba tank.

21. A device as defined in claim 16, wherein said vertical support column contains a pulling means.

22. A device as defined in claim 21, wherein said pulling means comprises a rodless type pneumatic or hydraulic cylinder and a pulling cable.

23. A device as defined in claim 16, further including means attached to said vertical support column for pivoting parallel linkage lifting arms, said parallel linkage lifting arms connecting said pivoting means on said vertical support column to said lifting means, and means for selectively pivoting said parallel linkage lifting arms to one of a plurality of positions.

24. A device as defined in claim 16, wherein said body engaging means comprises an under the arms and or around the chest support which remains horizontal when lifted or lowered and distribute lifting forces over a sizeable area of said person's torso and or limbs.

25. A device as defined in claim 16, wherein said lifting means comprises a flat platform which remains horizontal when moved between an upper or lower position, whereby a legless person may slide thereon and thereoff to make a transfer.

26. A device as defined in claim 16, wherein said lifting means further comprises:

parallel linkage lifting arms connected to said vertical support column; and an adjustable work surface having a predetermined angular position, said work surface being attached to said parallel linkage lifting arms, whereby said work surface remains in said angular position regardless of its position.

* * * * *